US008395116B2

(12) United States Patent
Harada et al.

(10) Patent No.: US 8,395,116 B2
(45) Date of Patent: Mar. 12, 2013

(54) MASS SPECTROMETER

(75) Inventors: Takahiro Harada, Kizugawa (JP); Kiyoshi Ogawa, Kizugawa (JP); Mitsutoshi Setou, Hamamatsu (JP)

(73) Assignees: Shimadzu Corporation, Kyoto (JP); National University Corporation Hamamatsu University School of Medicine, Shizuoka (JP)

( * ) Notice: Subject to any disclaimer, the term of this patent is extended or adjusted under 35 U.S.C. 154(b) by 197 days.

(21) Appl. No.: 13/094,659

(22) Filed: Apr. 26, 2011

(65) Prior Publication Data

US 2011/0266438 A1 Nov. 3, 2011

(30) Foreign Application Priority Data

Apr. 28, 2010 (JP) ..... 2010-102868

(51) Int. Cl.
*H01J 49/00* (2006.01)

(52) U.S. Cl. ..... 250/288; 250/281; 250/282

(58) Field of Classification Search ..... 250/281, 250/282, 286, 287, 288, 306, 307
See application file for complete search history.

(56) References Cited

FOREIGN PATENT DOCUMENTS

WO WO 2007/020862 A1 2/2007

OTHER PUBLICATIONS

Takahiro Harada et al., "Biological Tissue Analysis Using Mass Microscope", Shimadzu Review, vol. 64, No. 3/4, pp. 139-145, Apr. 24, 2008.

Kiyoshi Ogawa et al., "Research and Development of Mass Microscope", Shimadzu Review, vol. 62, No. 3/4, pp. 125-135, Mar. 31, 2006.

*Primary Examiner* — Jack Berman
*Assistant Examiner* — Hanway Chang
(74) *Attorney, Agent, or Firm* — DLA Piper LLP (US)

(57) ABSTRACT

A mass spectrometer capable of obtaining a clear microscopic observation image with high spatial resolution in real time, even during a mass analysis, without affecting the analysis is provided. An aperture 1*a* is formed in a stage 1 on which a sample plate 2 to be placed. The sample plate 2 is transparent or translucent. A microscopic observation unit, including an observation optical system 20 and a CCD camera 21, is provided below the stage 1 to observe the reverse side of the sample 3 through the aperture 1*a* of the stage 1 as well as the transparent sample plate 2. The observed image is displayed on the screen of a display unit 27. If the sample 3 is a slice of biological tissue, the sample image taken from the reverse side will be substantially the same as an image taken from the obverse side.

4 Claims, 3 Drawing Sheets

MASS SPECTROMETER

TECHNICAL FIELD

The present invention relates to a mass spectrometer, and more specifically to a mass spectrometer capable of selecting a portion or area (one-dimensional or two-dimensional area) of a solid, liquid, gel or any other form of samples by a microscopic observation of the sample, and performing a mass analysis on that portion or area.

BACKGROUND ART

Mass spectrometric imaging is a technique for investigating the distribution of a substance having a specific mass-to-charge ratio (m/z) by performing a mass analysis on each of a plurality of micro areas within a two-dimensional area on a sample, such as a piece of biological tissue. This technique is expected to be applied, for example, in drug discovery, biomarker discovery, and investigation on the causes of various diseases. Mass spectrometers designed for mass spectrometric imaging are generally referred to as imaging mass spectrometers. This device may also be called a mass microscope since its operation normally includes performing a microscopic observation of an arbitrary area on the sample, selecting a region of interest based on the observed image, and performing a mass analysis of the selected region. For example, the configurations of commonly known mass microscopes and analysis examples obtained with those mass microscopes are disclosed in Patent Document 1 as well as Non-Patent Documents 1 and 2.

A mass microscope is basically composed of a microscopic observation means for performing a microscopic observation of a two-dimensional area on a sample and a mass analysis means for performing a mass analysis for each of a plurality of portions within the two-dimensional area on the sample. The microscopic observation means can be divided into two major types: One type has an imaging means (e.g. a CCD camera) and a display unit (e.g. a monitor) with a screen on which an image taken with the imaging means can be displayed, thus allowing an operator to observe a sample image; the other type is a normal microscope having an eyepiece. The mass analysis means includes an ionization means for ionizing a component contained in a sample, an ion separation-detection means for separating the ions originating from the sample according to their mass-to-charge ratio and detecting each ion, and an ion transport means for guiding and transporting the ions generated from the sample to the ion separation-detection means.

The ionization means is typically a matrix assisted laser desorption ion source (MALDI ion source), a matrix-less laser desorption ion source (LDI), or a similar device. In these types of ion sources, a thin laser beam is thrown onto the sample, whereupon ions originating from sample components are generated at around the portion irradiated with the laser beam. The generated ions are extracted from the space near the sample by the action of an electric field and transferred to the ion separation-detection means via the ion transport means, such as an ion lens.

In the case where the ionization is performed under vacuum atmosphere, the electrodes and ion transport optical system for forming an electric field for extracting and accelerating ions generated from the sample are normally located above the sample placed on a sample plate. On the other hand, if the ionization is performed under atmospheric pressure, an ion intake port, which is used for drawing ions from the atmospheric pressure into a vacuum atmosphere where the ion separation-detection means is disposed, is arranged opposite to the sample. In any of these configurations, if an attempt is made to place the microscopic observation means above the sample to observe its surface, at least a portion of the aforementioned components of the mass analysis means spatially interferes with the microscopic observation means. Furthermore, such an arrangement may cause a decrease in the amount of ions supplied to the mass analysis due to the presence of the microscopic observation image in the path of the ions. To avoid such interference, various kinds of configurations have been proposed for the mass microscope.

For example, in the mass microscope shown in FIGS. 5-7 of Patent Document 1, an observation optical system is arranged so that a sample placed on a sample plate will be observed obliquely rather than from directly above (i.e. in the direction normal to the sample plate). This arrangement prevents the interference between the components of the microscopic observation means and those of the mass analysis means as well as the interference between the optical observation path and the transport path of the ions generated from the sample.

However, when the sample is observed from obliquely above rather than from directly above, the observed image becomes distorted, making it difficult to correctly perform the morphological observation of the sample. Furthermore, in some cases, the oblique observation allows only a limited portion of the visual field to come into focus, thus reducing the effective visual field. Another problem may result from the fact that the operating distance of the observation optical system inevitably becomes large to avoid the spatial interference between the observational optical path and the ion transport path or ion intake unit. Increasing the operating distance lowers the spatial resolution of the observed image, which may unfavorably affect the task of correctly selecting a desired area for the mass analysis.

In the mass microscope shown in FIG. 8 of Patent Document 1, a special type of observation optical system having an aperture for allowing the passage of ions is located directly above the sample. This optical system is designed so that a sample image can be laterally extracted for visual observation while allowing ions to be transported upwards through the ion-passing aperture and supplied for mass analysis. A mass microscope having such a configuration can create an image of the sample observed from directly above.

However, the presence of the ion-passing aperture at around the center of the observation optical system may cause a decrease in the contrast of the observed image at the center of the image or a defect in the visual field. Furthermore, the ions generated from the sample will not always travel in the direction normal to the sample plate; a portion of those ions will inevitably be spread away to some extent. This means that a portion of the ions generated from the sample do not pass through the ion-passing aperture but collide with the observation optical system, which may decrease the amount of ions supplied for the mass analysis and prevent the detection sensitivity from being sufficiently high. Another problem is that the laser irradiation causes various matters (e.g. fine particles), other than the ions, to be scattered from the sample and adhere to the observation optical system. Such contaminants may blur the observed image or cause a visual-field defect. Furthermore, the aforementioned special observation optical system having an uncommon construction may be considerably expensive.

In the mass microscopes shown in FIGS. 1 and 4 of Patent Document 1 or in Non-Patent Documents 1 and 2, the stage on which a sample is to be placed has a larger movable area so that the stage can be moved between the position for microscopic observation and the position for mass analysis. Since the observing position and the analyzing position are separated, it is possible to arrange the microscopic observation means above the observing position and the mass analysis means above the analyzing position so as to prevent the spatial interference between the components of these two means. Accordingly, a high-quality sample image observed from above can be obtained.

However, due to the separation between the observing position and the analyzing position, it is impossible to obtain a real-time image of the sample while the mass analysis of the sample is underway. Accordingly, the analysis operator cannot directly and visually check the irradiation point of the laser beam on the sample, which contributes to an uncertainty in the analyzing position. Furthermore, even if the sample is significantly consumed or damaged during the ionization process, the sample is separated from the sample plate, or an impurity (e.g. dust) sticks to the sample surface, the analysis operator cannot notice the problem during the analysis, continuing the analysis in vain. Furthermore, providing the stage with a large movable area will additionally increase the cost of the system.

BACKGROUND ART DOCUMENT

Patent Document

Patent Document 1: WO2007/020862

Non-Patent Document

Non-Patent Document 1: Ogawa et al., "Kenbi Shitsuryou Bunseki Souchi No Kaihatsu (Research and Development of Mass Microscope)", *Shimadzu Hyouron* (*Shimadzu Review*), Vol. 62, No. 3/4, pp. 125-135, Mar. 31, 2006

Non-Patent Document 2: Harada et al., "Kenbi Shitsuryou Bunseki Souchi Ni Yoru Seitai Soshiki Bunseki (Biological Tissue Analysis using Mass Microscope", *Shimadzu Hyouron* (*Shimadzu Review*), Vol. 64. No. 3/4, pp. 139-145, Apr. 24, 2008

DISCLOSURE OF THE INVENTION

Problem To Be Solved By the Invention

As described thus far, each of the conventional configurations proposed for avoiding the interference between the microscopic observation and the mass analysis in a mass microscope has its merits and demerits. That is to say, none of them completely satisfies the requirements that the device (1) should be capable of microscopic observation at high magnification, (2) should be free from the reduction or defect in the visual field or the blurring or distortion of the observed image, or other kinds of deterioration of the observed images, (3) should be low in production cost, (4) should not impede high-sensitivity mass analysis, and (5) should allow real-time observation of the sample while mass analysis is underway. The present invention has been developed in view of these points, with the aim of providing a mass spectrometer capable of satisfying the aforementioned requirements.

Means for Solving the Problems

The present invention aimed at solving the aforementioned problems is a mass spectrometer having a microscopic observation means for microscopically observing a sample held on a sample plate and a mass analysis means for performing a mass analysis on the sample within a portion or area selected using a result of observation performed with the microscopic observation means, wherein:

the sample plate is transparent or translucent;

the microscopic observation means is arranged on a side opposite from a side of the sample plate on which the sample is to be held; and a surface of the sample observed with the microscopic observation means is opposite from a surface on which the mass analysis is performed by the mass analysis means.

In the case where the mass spectrometer according to the present invention has a stage on which the sample plate is to be placed, it is preferable to provide the stage with an aperture through which the sample can be observed with the microscopic observation means. In this case, the sample plate will be exposed through the aperture formed in the stage.

The previously described conventional mass spectrometers of this type, the surface of the sample to be mass-analyzed is identical to the surface to be microscopically observed. By contrast, in the mass spectrometer according to the present invention, the surface to be observed with the microscopic observation means is opposite from the surface on which the mass analysis is performed. The observed surface is in contact with the sample plate, which is either transparent or translucent. That is to say, the microscopic observation means is designed to observe the reverse side of the sample beyond the sample plate (through the sample plate).

In the mass spectrometer according to the present invention, the mass analysis means includes an ionization unit for ionizing a sample, a mass separation unit for separating the generated ions according to their mass-to-charge ratio, and a detection unit for detecting the separated ions.

The ionization unit is typically a device for ionizing a sample by matrix assisted laser desorption ionization (MALDI) or matrix-less laser desorption ionization (LDI). However, it is also possible to use other ionization methods. For example, as in the case of the laser ablation inductively coupled plasma ionization (LA-ICP), the ionization unit may include an atomization means for selectively vaporizing or scattering the sample within a predetermined portion thereof into fine particles, and an ionization means for ionizing the generated fine particles. Other techniques which do not use any laser beam or which do not directly throw the laser beam onto the sample placed on the sample plate may also be used. Examples of such techniques include desorption electrospray ionization (DESI) and electrospray assisted laser desorption ionization (ELDI).

In most cases, the sample to be analyzed with the mass spectrometer according to the present invention is extremely thin and almost transparent or translucent, such as a piece of extremely thin tissue removed from a living body. Therefore, even when the sample is observed from the reverse side, the obtained image will be substantially the same as a sample image observed from the obverse side (i.e. the side on which the mass analysis is performed). Particularly, when a laser beam (which is typically within the ultraviolet region) is thrown onto the sample to ionize the sample, visible light is emitted as fluorescent light from the laser-irradiated portion to both obverse and reverse sides. Therefore, the irradiated portion will clearly appear in the image even if the sample is observed from the reverse side. Thus, an image that clearly shows the pattern, form and color of the sample can be obtained. Furthermore, the portion where the ionization is underway can be observed in real time on this image.

In one preferable mode of the mass spectrometer according to the present invention, the mass analysis means changes the two-dimensional position of the portion to be ionized on the sample, while performing the mass analysis for each portion to measure an ion intensity at one or more specific mass-to-charge ratios for each portion and create a two-dimensional distribution image of the ion intensity based on a result of the mass analysis.

To change the two-dimensional position of the portion to be ionized on the sample, the stage which the sample plate is placed on or attached to may be designed to be movable, in which case the ion intensity at one or more specific mass-to-charge ratios for each micro-sized portion of the sample can be obtained by repeating the mass analysis while moving the stage in a stepwise (intermittent) or continuous manner.

In another preferable mode of the mass spectrometer according to the present invention, the sample plate is an electrically conductive plate. In this case, a path for allowing electric charges to escape, for example, from the electrically conductive sample plate via the stage or other members can be formed so as to prevent electrical charge-up of the sample plate due to the ionization. This also prevents the lowering of the ion detection sensitivity due to the electrical charge-up of the sample plate. It also allows the scan speed to be increased to create a mapping image in a shorter period of time.

Effects of the Invention

In the mass spectrometer according to the present invention, since the sample is observed from its reverse side, the components of the microscopic observation means and the optical path for the observation will never spatially interfere with the transport path of the ions originating from the sample and the components of the mass analysis means, such as the ion intake unit. Hence, it is possible to observe the sample in the direction normal to the sample plate and at close range. Thus, a high-definition microscopic observation with high magnification can be easily performed without causing the distortion of the observed image or the reduction or defect in the visual field. Accordingly, the analysis operator can correctly recognize the micro-sized form, pattern and other properties of the sample and accurately select the portion or area to be analyzed.

It is unnecessary to use a special type of optical element for observation, such as an element with an ion-passing aperture or an element having a particularly high heat resistance. It is also unnecessary to intentionally increase the movable area of the stage only for the convenience of the microscopic observation. Accordingly, the present system can be produced at relatively low costs.

The components of the microscopic observation means do not interfere with the ions' motion, so that only a minor loss of ions occurs due to a collision with those components. Furthermore, there is no need to elongate the ion intake unit in order to avoid the interference with the components of the microscopic observation means. Accordingly, it is possible to avoid unnecessary loss of the ions and ensure an adequate amount of ions to perform the mass analysis with high sensitivity. The contamination of the components of the microscopic observation means (primarily, the observation optical system) due to the vapor or scattered matters from the sample as a result of the ionization is also prevented. Accordingly, no blurring of the observed image or defect in the visual field due to such contamination occurs.

Since the microscopic observation of the sample can be made without interfering with the mass analysis, it is possible to observe the sample in real time during the analysis (during the ionization process). Therefore, if any unfavorable situation for the analysis occurs (e.g. an excessive consumption of or damage to the sample due to the ionization, the separation of the sample from the sample plate, or the sticking of dust or other contaminants), the analysis operator can easily notice that situation and take necessary measures, such as immediately discontinuing the analysis if the analysis is inappropriate.

BEST MODE FOR CARRYING OUT THE INVENTION

As representative embodiments of the present invention, several forms of the mass microscopes are hereinafter described with reference to the drawings.

[First Embodiment]

Figure 1:
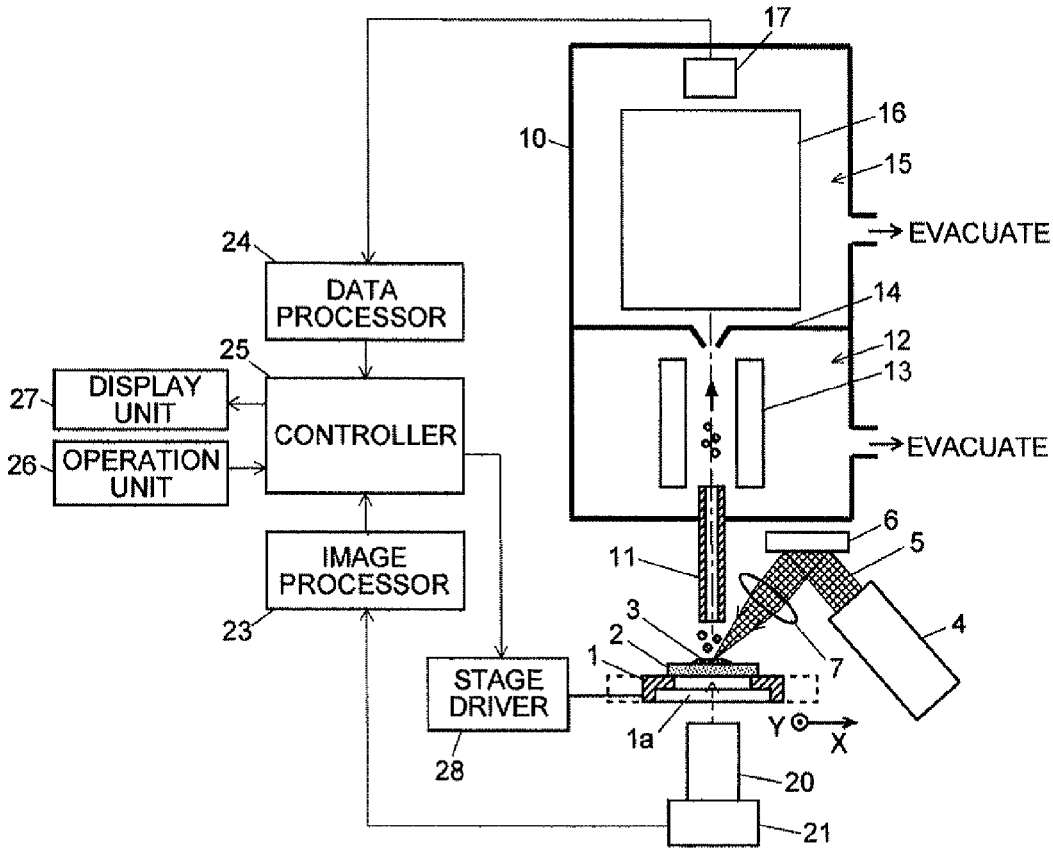
FIG. 1 is a configuration diagram showing the main components of a mass microscope according to the first embodiment of the present invention.

FIG. 1 is a configuration diagram showing the main components of a mass microscope according to one embodiment (first embodiment) of the present invention. The mass microscope according to this embodiment is designed to ionize a sample by atmospheric pressure matrix assisted laser desorption ionization (AP-MALDI) or atmospheric pressure laser desorption ionization (AP-LDI) which uses no matrix.

In the present mass microscope, the ionization is performed outside a vacuum chamber 10 evacuated with a vacuum pump (not shown). That is to say, the ionization takes place under atmospheric pressure. A sample 3 to be analyzed is applied to or placed on a sample plate 2. The sample plate 2 is placed on a stage 1, which can be moved by the drive power of a stage driver 28 including a motor along two orthogonal axes, i.e. in X and Y directions. For example, the sample 3 is a piece of extremely thin tissue sliced from a biological tissue. In the case of using an AP-MALDI method, an appropriate matrix is applied or sprayed on the top surface of the sample 3.

A laser beam 5 for ionizing the components in the sample 3 is emitted from a laser irradiation unit 4. After being reflected by a reflection optical system 6, this beam is converged into a micro-sized spot by a laser-condensing optical system 7 and thrown onto the sample 3. The inlet end of an ion transport tube 11 is open directly above the sample 3. This tube connects the inner space of the vacuum chamber 10 and the external space (which is at atmospheric pressure).

The inner space of the vacuum chamber 10 is separated into a first vacuum compartment 12 and the second vacuum compartment 15 by a partition wall 14, in which a skimmer is formed. The degree of vacuum in the second vacuum compartment 15 is higher than that in the first vacuum compartment 12 which communicates with the external atmosphere through the ion transport tube 11. Thus, the present mass microscope has the structure of a multi-stage differential pumping system in which the degree of vacuum increases in a stepwise manner in the traveling direction of the ions, whereby the inner space of the second vacuum compartment 15 is maintained at a high degree of vacuum.

The first vacuum compartment 12 contains an ion transport optical system 13 for transporting ions while focusing them by means of the effect of an electric field. The second vacuum compartment 15 contains a mass analyzer 16 for separating ions according their mass-to-charge ratio and an ion detector 17 detecting the separated ions. Examples of the ion transport optical system 13 include a static electromagnetic lens, a multi-electrode radio-frequency ion guide, and a combination of these devices. Examples of the mass analyzer 16 include a quadrupole mass filter, a linear ion trap, a three-dimensional quadrupole ion trap, an orthogonal acceleration time-of-flight mass analyzer, a Fourier transform ion cyclotron mass analyzer, or a magnetic sector mass spectrometer.

The characteristic of the present embodiment exists in the presence of an aperture 1*a* vertically penetrating the state 1 and the use of a transparent (or translucent) sample plate 2 to be placed on the stage 1. The microscopic observation unit including an observation optical system 20 and a CCD camera 21 is located below the stage 1, i.e. on the opposite side of the sample plate 2 from the sample 3.

The image signal produced by the CCD camera 21 is sent to an image processor 23, while the detection signal produced by the ion detector 17 is sent to a data processor 24. Based on the image signal, the image processor 23 creates an observed image of a predetermined area on the sample 3. Meanwhile, based on the ion detection signal, the data processor 24 calculates the mass-to-charge ratio and intensity (concentration) of an ion present on the region of interest. In the case where the region of interest on the sample 3 is two-dimensionally scanned, the data processor 24 also calculates the distribution of the ion intensity for each mass-to-charge ratio and creates a mapping image.

Upon receiving an operation from an operation unit 26, the controller 25 controls each component of the system to perform an analysis, and displays, on the screen of a display unit 27, a microscopic image created by the image processor display and an analysis result obtained by the data processor 24.

It is possible to use a microscope system for allowing an analysis operator to directly observe the sample 3 through an eyepiece, in place of the aforementioned display system using the display unit 27 on which users can visually check the image captured with the CCD camera 21. The observation optical system 20 may be constructed in different forms depending on the spatial resolving power or operating distance required for the observation. For example, it may consist of a single optical element, a module composed of a plurality of optical elements, or an even more complex system including a plurality of such modules.

The laser-condensing optical system 7 may also be constructed in different forms depending on the specifications of the laser irradiation unit 4, the required focusing diameter, and other factors. Similar to the observation optical system 7, it may consist of a single optical element, a module composed of a plurality of optical elements, or an even more complex system including a plurality of such modules.

An analysis operation of the mass microscope of the present invention is hereinafter described.

With reference to a microscopic observation image, an analysis operator initially determines which portion (area) on the sample 3 should be the target of the analysis. For that purpose, the CCD camera 21 captures, under the control of the controller 25, a microscopic image of the sample 3 through the aperture I a of the stage 1 and the transparent (or translucent) sample plate 2. The term "transparent" or "translucent" in the present context means that an almost entire or sufficiently large portion of light within the wavelength range used for the observation can pass through the plate. To obtain clearer observation images, the sample plate 2 should preferably as thin as possible within a range where it retains sufficient mechanical strength. Reducing the plate thickness not only increases the transmission rate of the observation light and thereby produces a brighter image, but also reduces the aberration of the observed image, whereby the resolution of the image is improved.

Figure 2:
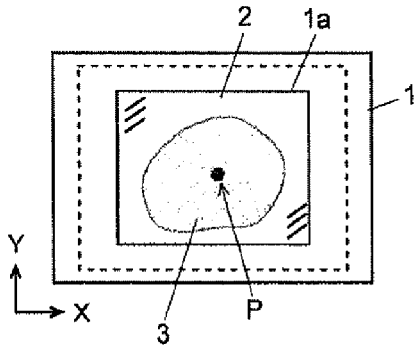
FIG. 2 is a schematic plan view showing the stage viewed from below in the mass microscope according to the first embodiment.

FIG. 2 is a schematic plan view of the stage 1 viewed from below. As already explained, the stage 1 has the aperture 1*a*. Therefore, when the sample plate 2 is placed on the stage 1, its reverse side will be exposed through the aperture 1*a*. The lower surface of the sample 3 on the sample plate 2 (i.e. the sample surface in contact with the sample plate 2) is visible through this aperture since the sample plate 2 is transparent or translucent. If the sample 3 is a slice of thin biological tissue, the sample 3 in itself is also almost transparent. Therefore, the image of the sample 3 observed from the reverse side will be almost the same as the sample image observed from the obverse side, or from above. Furthermore, when the sample 3 is irradiated with the laser beam, a visible fluorescent light is emitted from the irradiated portion, so that the laser-irradiated portion will be clearly visible even if the sample is observed from the reverse side.

When the microscopic image of the sample 3 is displayed on the screen of the display unit 27, if the analysis operator performs a predetermined operation on the operation unit 26, the magnifying power of the observation optical system 20 changes, whereby the enlargement ratio and visual field of the displayed image is varied. If another predetermined operation is performed by the analysis operator, the stage driver 28 is operated to move the stage 1 by an appropriate amount in X and/or Y directions, whereby the position of the observed image on the sample 3 is changed. While performing these operations as needed, the analysis operator visually checks the microscopic image of the sample 3. After the target of the analysis is determined, the operator selects its position and area through the operation unit 26.

As explained earlier, the displayed image is a microscopic image observed from the reverse side of the sample 3. However, the form, pattern, color and other properties of the sample 3 can be clearly recognized on this image. Since this microscopic image is an image viewed in the direction normal to the sample plate 2, it is free from the image distortion, visual-field defect and image blurring, which would occur in the case of an oblique observation. The observation optical system 20 can be brought extremely close to the sample plate 2 since it does not interfere with the path of the ionizing laser beam or the ion transport path. Thus, a high-definition microscopic observation with high spatial resolution can be performed, and the operator can correctly locate the portion or range to be analyzed on the sample 3.

Consider the case where a specific two-dimensional area on the sample 3 is selected as the target of the analysis. When the analysis operator enters through the operation unit 26 a command for initiating the analysis, the controller 25 determines the movement of the stage 1 (e.g. the amount and direction of its movement) based on the obtained image data as well as the information entered by the operator. Then, the stage driver 28 is controlled so as to move the stage 1 to an initial position for the analysis. Subsequently, a laser beam 5 with a specific power is emitted from the laser irradiation unit 4. Then, this laser beam is focused by the laser-condensing optical system 7 into a micro-sized spot and thrown onto the sample 3. Upon this laser irradiation, various kinds of substances contained near the irradiated portion of the sample 3 turn into vapor. These substances become ionized during the vaporization process.

The generated ions are drawn into the ion transport tube 11 primarily due to the pressure difference between the two ends of this tube 11, and carried by an air flow into the first vacuum compartment 12. Within the first vacuum compartment 12, the ions are converged by the ion transport optical system 13 and sent into the second vacuum compartment 15, where the ions are separated by the mass analyzer 16 according to their mass-to-charge ratio and reach the ion detector 17. The ion detector 17 produces an electric current corresponding to the number of the received ions and outputs the electric current as a detection signal. For example, if the mass analyzer 16 is a quadrupole mass filter, a plurality of ions having different mass-to-charge ratios are sequentially detected by the ion detector 17 with the elapse of time during one scan cycle, while the data processor 24 can obtain a mass spectrum for the analyzed portion.

While the laser beam is being thrown on the sample 3 in the previously described manner, the analysis operator can locate the irradiation point of the laser beam on the real-time microscopic image displayed on the screen of the display unit 27. On this image, the operator can check various points during the analysis in real time, such as whether the laser beam is certainly falling onto the intended point, whether there is any impurities such as dust at the irradiation point of the laser beam, or whether there is any problem with the laser irradiation (e.g. an abnormally large spot diameter of the laser beam). For example, if a certain kind of problem is found, the operator can immediately discontinue the analysis to avoid consuming unnecessary time for a wasteful analysis and prevent any unwanted damage to the sample 3.

After the mass analysis of one portion within the specified two-dimensional area is completed, the controller 25 operates the stage driver 28 to move the stage 1 to the next position. After the stage 1 is moved, the laser beam is thrown onto the sample 3 and a mass analysis is performed on the irradiated portion, as in the previous case. In this manner, the mass analysis is sequentially performed for each portion within the specified two-dimensional area to obtain mass-spectrum information for each portion. After the entire analysis is completed, the data processor 24 collects signal-intensity data for each portion and for a specific mass-to-charge ratio which is specified, for example, through the operation unit 26, and creates a mapping image (two-dimensional distribution image) for that mass-to-charge ratio. The controller 25 displays the mapping image a microscopic image of the sample 3 on the screen of the display unit 27, associating the two images with each other.

The vapor and desorbed matters generating from the sample 3 do not always directly move in the direction normal to the sample plate 2; it is inevitable that they will be scattered into the surrounding area to some extent. In the construction according to the previous embodiment, such scattered matters cannot stick to the observation optical system 20, and the blurring of the observed image or the defect in the visual field barely occurs due to such a contamination.

The previous description assumed that and a mass analysis was performed on a two-dimensional area on a single piece of biological tissue placed as the sample 3 on the sample plate 2. It is also possible to sequentially perform an analysis on a number of samples 3 spotted, for example, in a grid-like pattern on the sample plate 2.

In such a case, the sample can be prepared as follows: A specimen is initially dissolved in a solution, and this solution is further mixed with a matrix solution. Then, the mixture is spotted on the sample plate 2 and dried. During the drying process, the matrix crystallizes, with the specimen incorporated therein. This crystal will be the target of laser irradiation in the ionizing process. The size of the crystal depends on the type of the used matrix but will be no greater than several hundred micrometers. To accurately throw the laser beam onto such a small crystal, it is necessary to observe the sample with a spatial resolution comparable to, or even smaller than, the crystal size. Furthermore, it should be noted that not every portion of the crystal is suitable for laser irradiation. Any crystal normally has a "sweet spot", i.e. a portion that is capable of more efficiently producing ions than the other portions. For a high-sensitivity analysis, it is desirable to throw the laser beam onto the sweet spot. It is not guaranteed that the sweet spot can always be recognized by a morphological observation of the sample. However, if the fine form of the crystal is revealed by the observation, it is possible to repeatedly and precisely throw the laser beam, aiming at the sweet spot. Given this factor, the sample observation should preferably be performed with a spatial resolving power equal to or finer than several tens of micrometers. For the mass microscope of the present embodiment, it is easy to realize a microscopic observation at this level of spatial resolution.

[Second Embodiment]

Figure 3:
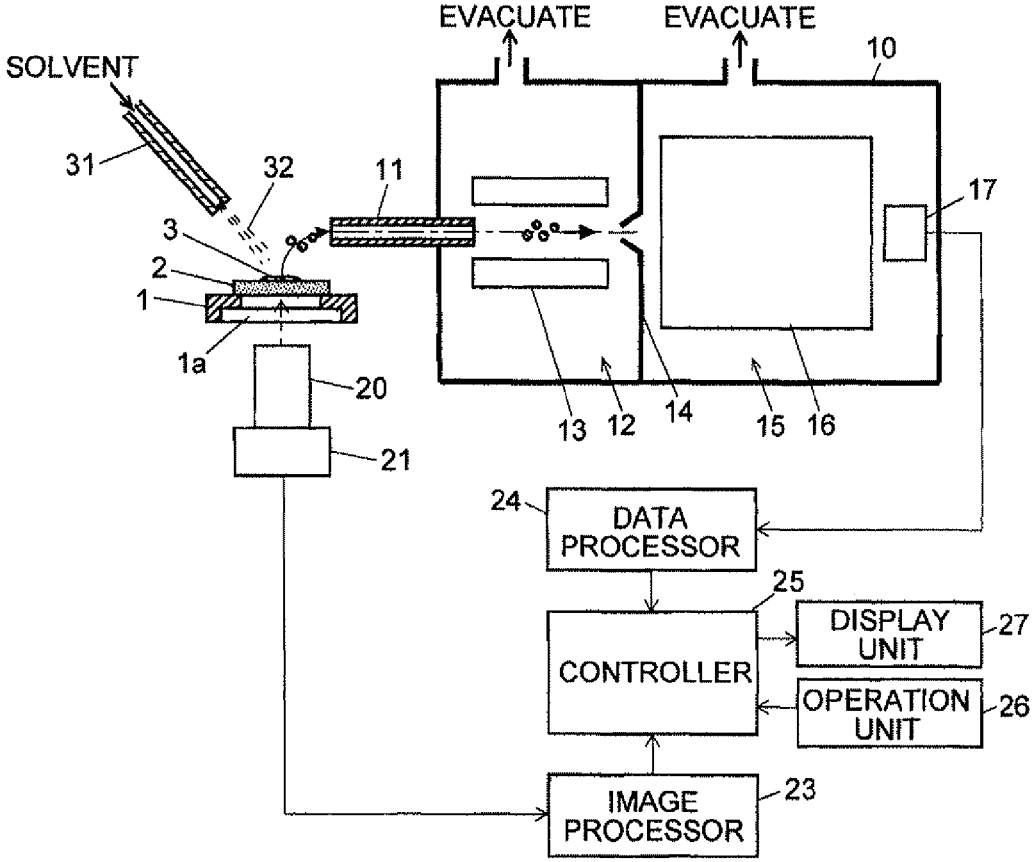
FIG. 3 is a configuration diagram showing the main components of a mass microscope according to the second embodiment of the present invention.

FIG. 3 is a configuration diagram showing the main components of a mass microscope according to another embodiment (second embodiment) of the present invention. In FIG. 3, the components which are identical to those used in the configuration of the first embodiment shown in FIG. 1 are denoted by the same numerals. The mass microscope according to the second embodiment uses desorption electrospray ionization (DESI) as the ionization method. A detailed description of the DESI is available, for example, in Zoltán Takáts et al., "Mass Spectrometry Sampling Under Ambient Conditions with Desorption Electrospray Ionization", *Science,* 2004, Vol. 306, No. 5695, pp. 471-473.

This mass microscope has an electrospray nozzle 31, which gives a biased electric charge to a predetermined type of solution continuously supplied from a liquid supply unit (not shown). The charged solution passes through an extremely narrow hole, to be sprayed onto the sample 3. When the plume 32 of charged droplets collides with and adheres to a predetermined position on the sample 3, a portion of the sample 3 in the nearby area is desorbed and ionized. The process of observing the sample 3 and determining the analysis position based on the observed image is the same as described in the first embodiment; the observed image is taken from the reverse side of the sample 3 through the aperture 1*a* formed in the stage 1 and the transparent (or translucent) sample plate 2.

In this configuration, since the plume 32 exists directly above the sample 3, it is practically impossible to observe the sample 3 from above and at a short operating distance. However, in the case of the present embodiment, a fine microscopic image with high spatial resolution can be obtained since the sample 3 can be observed from directly below and from an extremely short distance, without being influenced by the presence of the plume 32.

It should be noted that the horizontal arrangement of the ion transport tube 11 and the mass analysis unit in the following stage in the second embodiment has no essential difference from the vertical arrangement in the first embodiment.

The same effect can be obtained, for example, in the base of an ionization method called DART (Direct Analysis in Real Time) described in Robert B. Cody et al., "Versatile New Ion Source for the Analysis of Materials in Open Air under Ambient Conditions", *Analytical Chemistry,* 2005, Vol. 77, No. 8, pp. 2297-2302. In the case of DART, an active chemical species in an excited state is produced from nitrogen, helium or another kind of gas by the action of a voltage applied to a needle electrode. Similar to the aforementioned plume, this active chemical species is sprayed onto a sample, whereupon the components in the sample are ionized due a chemical reaction.

[Third Embodiment]

Figure 4:
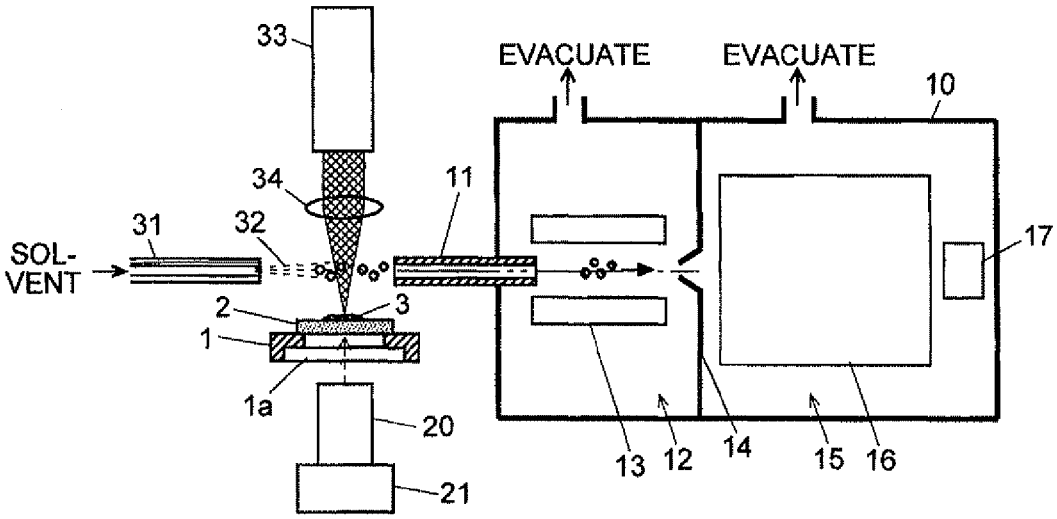
FIG. 4 is a configuration diagram showing the main components of a mass microscope according to the third embodiment of the present invention.

FIG. 4 is a configuration diagram showing the main components of a mass microscope according to still another embodiment (third embodiment) of the present invention. In FIG. 4, the components which are identical to those used in the configuration of the first embodiment shown in FIG. 1 or the second embodiment shown in FIG. 3 are denoted by the same numerals. The mass microscope according to the third embodiment uses electrospray-assisted laser desorption ionization (ELDI) as the ionization method. A detailed description of the ELDI is available, for example, in Min-Zong Huang et al., "Direct Protein Detection from Biological Media through Electrospray-Assisted Laser Desorption Ionization/Mass Spectrometry", *J. Proteome Res.,* 2006, Vol. 5, No. 5.

In this mass microscope, a desorption laser irradiation unit 33 and a laser-condensing optical system 34 are located above the sample plate 2. An electrospray nozzle 31 is arranged so that a plume 32 of charged droplets will be sprayed into the space above the sample plate 2. When a micro-sized spot of the laser beam is thrown onto the sample 3, the sample 3 is vaporized and desorbed from an area near the irradiated point. The fine particles of the desorbed sample are mixed into the plume 32 generated by the electrospray nozzle 31, where the sample is ionized by the action of the charged droplets. Similar to the second embodiment, the sample 3 in the present embodiment can be observed from below and from an extremely short distance, without being influenced by the presence of the plume 32 and the laser irradiation unit. Thus, a fine microscopic image with high spatial resolution can be obtained.

Figure 5:
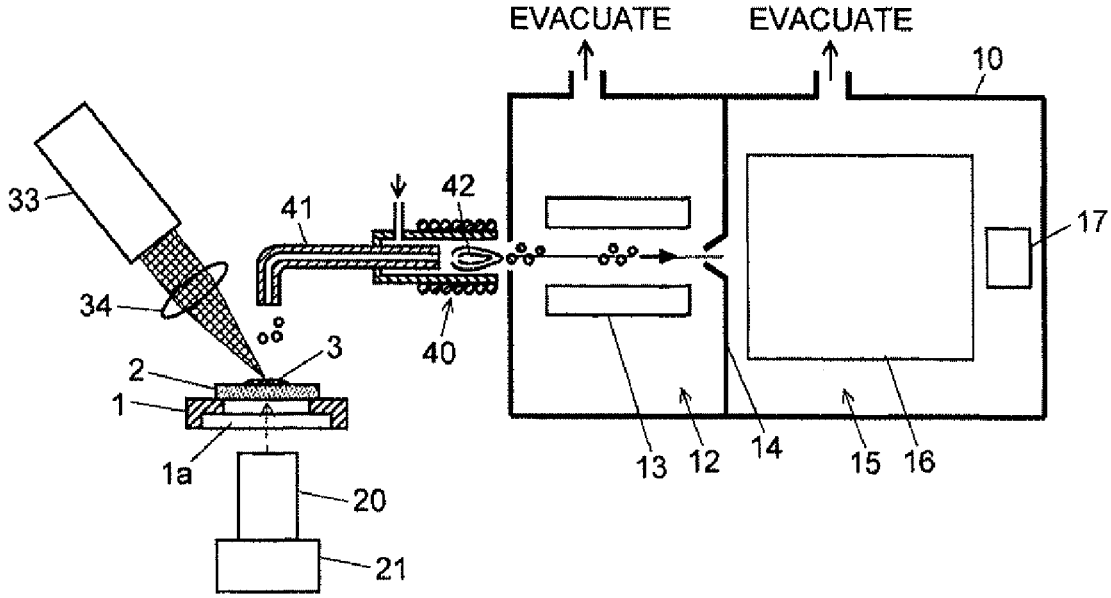
FIG. 5 is a configuration diagram showing the main components of a mass microscope according to the fourth embodiment of the present invention.

FIG. 5 is a configuration diagram showing the main components of a mass microscope according to still another embodiment (fourth embodiment) of the present invention. In FIG. 5, the components which are identical to those used in the configuration of the first through third embodiments shown in FIGS. 1, 3 and 4 are denoted by the same numerals. The mass microscope according to the fourth embodiment uses laser ablation inductively coupled plasma ionization (LA-ICP) as the ionization method.

The laser beam emitted from the desorption laser irradiation unit 33 is converged into a micro-sized spot by the laser-condensing optical system 34 and thrown onto a predetermined point on the sample 3. Due to this laser irradiation, the sample 3 is desorbed from an area near the irradiation point. The fine particles of the sample 3 are drawn into the sample introduction tube 41 of the ICP unit 40, in which the sample 3 is ionized inside the ICP torch 42. The generated ions are sent into the first vacuum compartment 12, to be subjected to mass analysis as described in the previous embodiments.

In this configuration, the intake port of the sample introduction tube 41 is provided directly above and at an extremely short distance from the sample 3. However, this arrangement does not impede the sample observation since the sample can be observed from below and from an extremely short distance. Thus, a fine microscopic image with high spatial resolution can be obtained.

In any of the previously described embodiments, the sample plate 2 may be made of any material as long as it is transparent or translucent. However, the surface of the sample 3 itself or the sample plate 2 may become electrically charged up (i.e. the buildup of electrical charges occurs) depending on the material of the sample plate 2, the condition of ionization of the sample 3 or other factors. If the electrical charge-up occurs, the electric field created by those charges pulls the generated ions back to the sample 3, which decreases the amount of ions supplied to the mass analysis and thereby lowers the detection sensitivity. Furthermore, in some cases, it may directly decrease the ion-generation efficiency.

This problem can be avoided by providing the sample plate 2 with an electrically conductive surface at least on the side where the sample is to be placed 3, and ensuring a path for the charges building up in the sample plate 2 to escape from the same plate 2.

Figure 6:
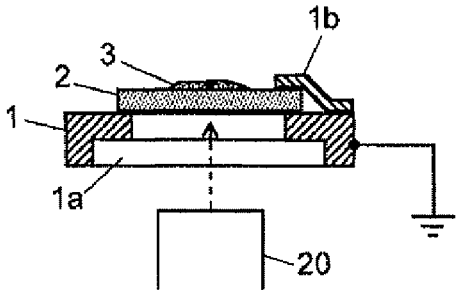
FIG. 6 is a configuration diagram showing the main components of a mass microscope according to the fifth embodiment of the present invention.

More specifically, the sample plate 2 may be a glass plate having a sample-holding surface coated with ITO (indium tin oxide), ZnO (zinc oxide), $SnO_2$ (tin oxide) or a similar compound. Such a sample plate ensures both the transmittance to the light for observation and the electrical conductivity on the plate surface. The coating, which should have an appropriate electrical conductivity, can be formed by a sputtering process, vacuum deposition or other techniques. It should be naturally understood that the sample plate 2 may be made of a bulk member that is transparent and conductive. Additionally, as shown in FIG. 6, an electrically conductive presser bar spring 1*b,* which is in contact with the surface of the sample plate 2 and presses the same plate onto the stage 1, may be provided to electrically connect the surface of the sample plate 2 and the metallic stage 1, and this stage 1 may be connected to a ground of the apparatus. Thus, an escape path for the electric charges can be formed.

It should be noted that the previously described embodiments are mere examples of the present invention, and any change, modification or addition appropriately made within the spirit of the present invention will naturally fall within the scope of claims of the present patent application.

Explanation of Numerals

1 . . . Stage
1*a* . . . Aperture
2 . . . Sample Plate
3 . . . Sample
4 . . . Laser Irradiation Unit
5 . . . Laser Beam
6 . . . Reflection Optical System
7 . . . Laser-Condensing Optical System
10 . . . Vacuum Chamber
11 . . . Ion Transport Tube
12 . . . First Vacuum Compartment
13 . . . Ion Transport Optical System
14 . . . Partition
15 . . . Second Vacuum Compartment
16 . . . Mass Analyzer
17 . . . Ion Detector
20 . . . Observation Optical System
21 . . . CCD Camera
23 . . . Image Processor
24 . . . Data Processor
25 . . . Controller
26 . . . Operation Unit
27 . . . Display Unit

28 . . . Stage Driver
31 . . . Electrospray Nozzle
32 . . . Plume
33 . . . Desorption Laser Irradiation Unit
34 . . . Laser-Condensing Optical System
40 . . . ICP (Inductively Coupled Plasma) Unit
41 . . . Sample Injection Tube
42 . . . ICP Torch

The invention claimed is:

1. A mass spectrometer having a microscopic observation means for microscopically observing a sample held on a sample plate and a mass analysis means for performing a mass analysis on the sample within a portion or area selected using a result of observation performed with the microscopic observation means, wherein:

the sample plate is transparent or translucent;

the microscopic observation means is arranged on a side opposite from a side of the sample plate on which the sample is to be held; and a surface of the sample observed with the microscopic observation means is opposite from a surface on which the mass analysis is performed by the mass analysis means.

2. The mass spectrometer according to claim 1, wherein the mass analysis means changes a two-dimensional position of a portion to be ionized on the sample, while performing a mass analysis for each portion to measure an ion intensity at one or more specific mass-to-charge ratios for each portion and create a two-dimensional distribution image of the ion intensity based on a result of the mass analysis.

3. The mass spectrometer according to claim 2, wherein the sample plate is an electrically conductive plate.

4. The mass spectrometer according to claim 3, wherein a path for allowing electric charges to escape from the sample plate is formed so as to prevent electrical charge-up of the sample plate due to ionization.

* * * * *